United States Patent [19]

Humphrey et al.

[11] 4,086,664

[45] May 2, 1978

[54] FOOTBALL FACE GUARD

[75] Inventors: Delby C. Humphrey, Terre Haute, Ind.; Robert D. Humphrey, Litchfield, Ill.

[73] Assignee: Schutt Manufacturing Company, Litchfield, Ill.

[21] Appl. No.: 718,058

[22] Filed: Aug. 26, 1976

[51] Int. Cl.[2] ..... A42B 3/00

[52] U.S. Cl. ..... 2/9

[58] Field of Search ..... 2/9, 10, 424

[56] References Cited

U.S. PATENT DOCUMENTS

| | | | |
|---|---|---|---|
| 3,319,261 | 5/1967 | Dunning | 2/9 |
| 3,729,746 | 5/1973 | Humphrey | 2/9 |
| 3,854,146 | 12/1974 | Dunning | 2/9 |
| 3,900,897 | 8/1975 | Dunning | 2/9 |

*Primary Examiner*—Werner H. Schroeder
*Assistant Examiner*—Peter Nerbun
*Attorney, Agent, or Firm*—Albert L. Jeffers; Roger M. Rickert

[57] ABSTRACT

A football face guard adapted for connection to the forward side of a football helmet in which the top of the face guard is pivotally connected to the helmet so the guard is swingable on the helmet in the fore and aft direction. The sides of the face guard are connected to the helmet by connectors which extend angularly upwardly toward the rear while the portion of the face guard engaged by the connectors is inclined in a direction perpendicular to the direction of inclination of the connectors.

8 Claims, 3 Drawing Figures

FOOTBALL FACE GUARD

The present invention relates to face guards, especially to football face guards, and is particularly concerned with an improved arrangement for constructing the face guard and for connecting it to a helmet.

Face guards of the nature with which the present invention is concerned are known and generally comprise a grid of bar elements which are interconnected to form the face guard and connecting elements for connecting the face guard to a helmet.

The bar elements making up the guard are advantageously formed of wire or tubing with the wires or tubing being interconnected where they cross over as by welding. The entire face guard is then coated with a resilient rubber-like coating of substantial thickness. The guard can be constructed in other ways, but the aforementioned type is preferred because of the great strength against breaking.

Face guards of the nature referred to are subjected to severe shock loading when in use, and if not connected to the helmet in a proper manner, can even cause cracking of the helmet and possible dislodging of the face guard from the designated position thereof, either of which can be dangerous to the player who is depending on the guard for protection. It is also possible for the connecting elements used to connect the face guard to the helmet to bend or twist, and this, also, can permit movement of the face guard on the helmet and cause severe strains to be set up in the helmet.

With the foregoing in mind, a primary objective of the present invention is the construction of a face guard, especially for football helmets, which avoids the drawbacks referred to above but which does not, in any way, complicate the mounting of the face guard on the helmet.

BRIEF SUMMARY OF THE INVENTION

According to the present invention, a face guard according to the present invention is made up of a plurality of bar-like elements in curved and overlapping relation. The elements include metal cores which are interconnected where the elements cross over one another as by welding. The guard also includes a support element configured to fit along a helmet near the edge of the face opening and to which the guard elements are connected. The guard elements and support elements make up the guard, and the guard, in its entirety, is coated with a rubber-like coating of substantial thickness.

According to the present invention, strap-like connectors connect the support element near the center of the helmet at the top of the face opening while other connectors connect the sides of the guard to the helmet. The last-mentioned connectors are connected to the lower part of the sides of the support element and are, thus, displaced downwardly from the point of connection of the upper part of the support element to the helmet.

The lower part of the sides of the support element, and which are engaged by the connectors, incline downwardly and toward the rear at an angle of about 45°, and the respective connector elements embrace this inclined portion of the lower part of the support element and extend upwardly and rearwardly therefrom to an adjacent point of connection of the connectors to the helmet.

The arrangement is such that blows delivered to the face guard from the front tend to cause the bottom of the face guard to swing rearwardly about an axis defined by the top connecting members and, with the lower connecting members inclined as mentioned, the lower connecting members are ideally situated to absorb the shock without twisting and without unduly stressing the helmet.

At the same time, in an emergency situation, the lower connectors of the sides of the face guard, and which are of a resilient rubber-like material, can be cut, and the face guard can then be swung upwardly to expose the player's face for the administration of oxygen or other emergency treatment.

The exact nature of the present invention will become more clearly apparent upon reference to the following detailed specification taken in connection with the accompanying drawings in which.

DETAILED DESCRIPTION OF THE INVENTION

Figure 1:
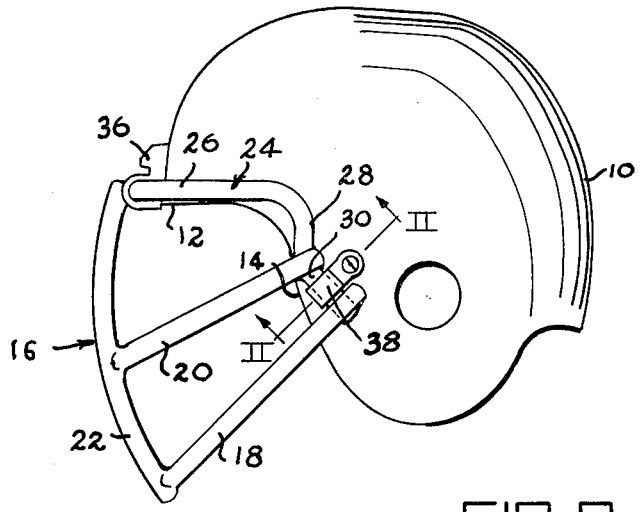
FIG. 1 is a side view of a helmet according to the present invention.

Referring to the drawings somewhat more in detail, in FIG. 1, a typical football helmet is shown at 10 and having a face opening on the forward side defined by an upper edge 12 and at the sides by the forwardly facing, substantially vertical edge 14.

A face guard, generally indicated at 16, is mounted on the helmet and is, in general, a rearwardly concave grill of interconnected elements which protects the face of the individual wearing the helmet.

The face guard illustrated in the drawings comprises an arcuate, rearwardly concave lower guard element 18 extending downwardly at an angle of about 40° to 50° from the horizontal and an upper guard element 20 also concave toward the rear and extending downwardly at an angle of from about 20° to 35° to the horizontal.

The guard elements 18 and 20 are interconnected by a vertically extending third guard element 22 which is fixed to guard elements 18 and 20 and centers thereof and which may extend vertically upwardly to the top of the face guard, and in which case the upper end thereof is connected to the forward side of a support element 24 by means of which the guard is not only made rigid but also connected to the helmet 10.

Support element 24 comprises an upper portion 26 to which the upper end of vertical guard element 22 is connected and which is configured to lie along the upper edge 12 of the face opening of the helmet. Toward the rearward ends of the upper portion of support member 24, the support member bends downwardly to form side portions 28 which extend along the side edges 14 of the face opening of the mask. Side portions 18 extend downwardly and then rearwardly at an angle of about 45° so that end parts 30 are defined near the lower ends of side portions 28 for receiving connector elements.

Figure 2:
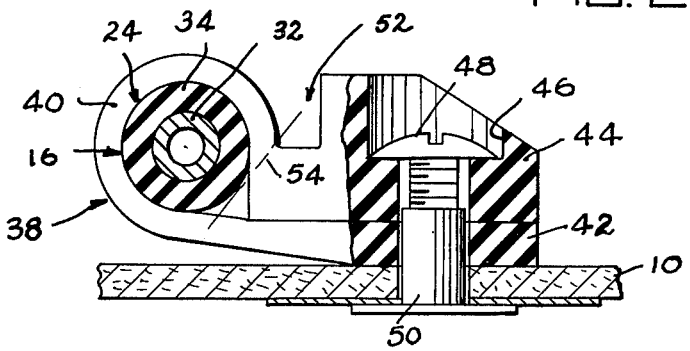
FIG. 2 is a section on line II—II of FIG. 1 showing a typical connecting element for connecting the face guard to the helmet.

The guard referred to is advantageously made up of wire or tubing which form the cores of the guard and support elements and which are interconnected, as by welding, at the points of overlap, while the entire guard is coated with resilient material to a substantial thickness. In FIG. 2, a typical core is shown at 32 with the resilient coating of the mask located at 34.

At the top of the face guard, in about the center of support element 24, there is a pair of connector members 36 with only one being shown in FIG. 1. Furthermore, along the inclined lower end parts 30 of the side portions of the support element, there are similar connectors 38 which, as will be seen, extend upwardly perpendicularly from the parts 30 to points of connection on the helmet rearwardly of the parts 30.

Each of the connectors can be constructed as shown in FIG. 2 wherein the connector 38 will be seen to comprise a strap having an intermediate portion 40 adapted closely to embrace the adjacent region of support element 24. One end of strap portion 40 continues outwardly as at 42 and is adapted to engage the outer surface of helmet 10. The other end of strap portion 40 has a block-like configuration 44 formed thereon which is adapted to engage portion 42 in face to face relation.

A counterbore 46 on portion 44 receives a screw 48 which is threaded into a nut 50 extending outwardly from inside the helmet so that the screw 48 provided in each connection device firmly holds the connecting device in the adjacent portion of the face guard in substantially fixed relation to the helmet 10.

It will be noted that the connecting element has a notch 52 formed therein which can prove to be of particular benefit on occasion. In the first place, the notch assists in imparting some resilience to the connector element so that blows on the forward portion of the mask can be absorbed without creating dangerous peak stresses in helmet 10.

Further, should a player wearing the helmet require emergency treatment, a knife can be introduced into notches 52 of the side connectors 38 and each connector cut along the dot-dash line at 54, whereupon the face guard can be swung upwardly about the axes formed by the connecting elements 36 at the top of the guard thereby exposing the player's face without exposing the player to the hazard of removing a tight-fitting helmet from his head.

Figure 3:
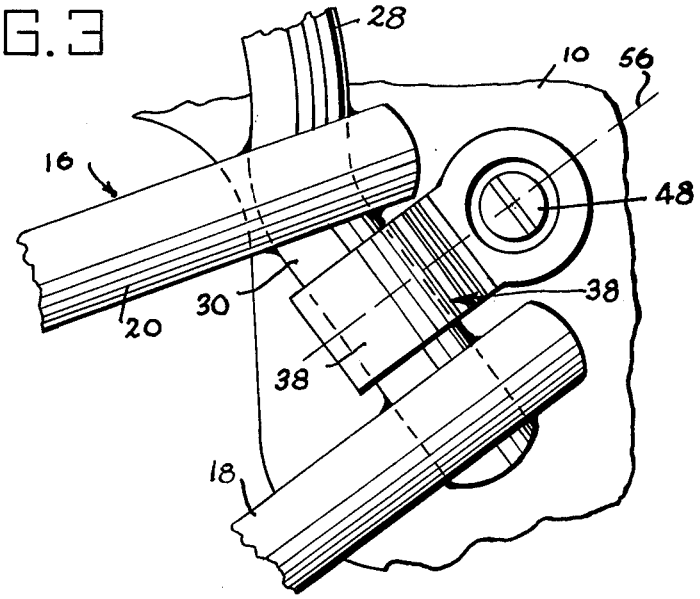
FIG. 3 is an enlarged view looking in at the side of the helmet and showing the configuration of the face guard adjacent the lower connector and the engagement thereof by the lower connector.

As will be seen in FIGS. 1 and 3, guard elements 18 and 20 have their rearward ends in overlapping relation to rearwardly inclined end part 30 of the side parts 28 to the support element 24 and are, as mentioned before, fixedly connected thereto. It will be noted that the longitudinal axis of the connecting element 38 shown in FIG. 3, said axis being indicated by line 56, is generally tangential to the axis defined by upper connector device 36 so that the connector elements 38 are ideally situated to sustain blows exerted on the front of the face guard without twisting of the connecting elements which would permit displacement of the face guard on the helmet and, also, induce extreme stresses in the material of the helmet.

Also, the connecting elements 38 are so disposed as to be able substantially directly to absorb the loading that is thus imposed on the face guards and can exert substantially the utmost in cushioning effect thereby diminishing the shock loading that is exerted on the helmet when the face guard has a blow delivered thereto.

Referring again to the notch 52, it will be evident that other expedients could be resorted to to provide for a desired degree of resilient or yieldable support to the bar portion 30 that is embraced by connector element 38.

For example, the connector element could be notched from the inside, or material could be removed from the connector element by molding holes therein extending parallel to bar portion 30 and in each case, resilience will be imparted to the support provided for bar portion 30, thereby cushioning shocks applied to the face guard from the front.

Modifications may be made within the scope of the appended claims.

What is claimed is:

1. A face guard for mounting on a protective helmet having a face opening with a top edge and side edges, said guard comprising; a plurality of laterally extending curved guard elements adapted to extend across the face opening of the helmet and a support element to which the rearward ends of said guard elements are connected, said support element having a top portion extending across the top edge of the helmet face opening and side portions extending down along the side edges of the face opening of the helmet, resilient first connector means rotatably engaging said support element top portion near the center and having means protruding from one side thereof adapted for connection to the adjacent region of the helmet, and resilient second connector means engaging a lower end part of each support element side portion near the lower end thereof and having means protruding from one side thereof adapted for connection to the adjacent region of the helmet rearwardly of the respective support element, each said lower end part of said support element side portion inclining downwardly toward the rear to dispose said lower end parts at such an angle that impacts delivered to the outwardly facing side of the face guard will be substantially at right angles to the axis of each said lower end part of the support member, the rearward ends of a pair of said guard elements being secured to each said lower end part on opposite sides of the respective second connector means in closely spaced relation thereto.

2. A face guard according to claim 1 in which each second connector means comprises a strap which closely encircles the respective lower end part and has the ends brought together in superposed relation on the rearward side of said lower end part, a screw extending through said superposed ends and the helmet therebeneath, and a nut inside the helmet engaging the screw.

3. A face guard according to claim 1 in which said support element side portion lower end parts are substantially perpendicular to a circle having the center at the center of the top portion of said support element.

4. A face guard according to claim 1 in which said guard elements include a pair of vertically spaced elements curved so as to be rearwardly concave and each inclining downwardly in the forward direction, each of said pair of guard elements having the rearward ends connected to said lower end parts of said support element side portions in spaced relation and closely adjacent opposite sides of said second connector elements.

5. A face guard according to claim 1 in which said guard elements include a pair of vertically spaced elements curved so as to be rearwardly concave and each inclining downwardly in the forward direction, each of said pair of said guard elements having the rearward ends connected to said lower end parts of said support element side portions in spaced relation and closely adjacent opposite sides of said second connector elements, the lower one of said pair of guard elements inclining downwardly in the forward direction at an angle of about 40° to 50° and the upper one of the pair of guard elements inclining downwardly in the forward direction at an angle of about 25° to 35° to the horizontal.

6. A face guard according to claim 1 in which said first connector means connect the center part of said support element top portion to the helmet for pivotal movement of the guard on the helmet about a transverse axis defined by said first connector means, said second connector means resiliently restraining said lower end parts of said support element side portions and said means protruding therefrom for connection to the helmet extending upwardly in the rearward direction from said lower end parts in a direction such as to absorb shock loading on said guard without twisting of said second connector means.

7. A face guard according to claim 6 in which each said second connector means has a predetermined degree of resilience in the fore and aft direction.

8. A face guard according to claim 1 in which each said second connector means includes a region of reduced thickness interposed between the portion of the second connector means that engages the support member and the portion of the connector means that protrudes therefrom for connection to the helmet and which region is easily severable by a knife to release the guard for pivotal movement about the axis of said first connector means to expose the face of the individual wearing the helmet.

* * * * *